US010160578B2

(12) United States Patent
Harvey

(10) Patent No.: US 10,160,578 B2
(45) Date of Patent: Dec. 25, 2018

(54) CHILD RESISTANT LID AND PACKAGING

(71) Applicant: Eric Harvey, Bend, OR (US)

(72) Inventor: Eric Harvey, Bend, OR (US)

( * ) Notice: Subject to any disclaimer, the term of this patent is extended or adjusted under 35 U.S.C. 154(b) by 0 days.

(21) Appl. No.: 14/968,358

(22) Filed: Dec. 14, 2015

(65) Prior Publication Data

US 2016/0167845 A1 Jun. 16, 2016

Related U.S. Application Data

(60) Provisional application No. 62/091,750, filed on Dec. 15, 2014.

(51) Int. Cl.

| | |
|---|---|
| ***B65D 51/18*** | (2006.01) |
| ***B65D 77/04*** | (2006.01) |
| ***B65D 23/08*** | (2006.01) |
| ***B65D 65/08*** | (2006.01) |
| ***B65D 50/04*** | (2006.01) |
| ***B65D 43/02*** | (2006.01) |
| ***B65D 25/34*** | (2006.01) |

(52) U.S. Cl.

CPC ..... *B65D 51/18* (2013.01); *B65D 23/0857* (2013.01); *B65D 25/34* (2013.01); *B65D 43/0225* (2013.01); *B65D 50/041* (2013.01); *B65D 65/08* (2013.01); *B65D 77/0486* (2013.01); *B65D 2215/02* (2013.01); *B65D 2251/009* (2013.01); *B65D 2251/0018* (2013.01); *B65D 2251/0028* (2013.01); *B65D 2251/0081* (2013.01)

(58) Field of Classification Search

CPC ..... B65D 51/18; B65D 43/0225; B65D 43/0231; B65D 25/34; B65D 23/0842; B65D 23/0857; B65D 65/08; B65D 50/041; B65D 23/08; B65D 23/0885; B65D 77/0486

USPC ..... 220/739, 737, 62.12, 732, 23.91; 215/12.1, 201, 208, 217, 206, 218, 219, 215/220

See application file for complete search history.

(56) References Cited

U.S. PATENT DOCUMENTS

| | | | | | |
|---|---|---|---|---|---|
| 2,980,274 | A * | 4/1961 | Gould | B65D 50/041 | 215/220 |
| 2,990,075 | A * | 6/1961 | Rhodes | B65D 50/041 | 215/220 |
| 3,622,027 | A * | 11/1971 | Maki | B65D 50/041 | 215/220 |
| 3,809,272 | A * | 5/1974 | Maki | B65D 50/041 | 215/219 |
| 3,812,990 | A * | 5/1974 | Willis | B65D 50/041 | 215/219 |
| 5,938,016 | A * | 8/1999 | Erdtmann | A45D 40/0068 | 206/219 |

(Continued)

*Primary Examiner* — Jeffrey Allen
*Assistant Examiner* — Jennifer Castriotta
(74) *Attorney, Agent, or Firm* — Eric Harvey

(57) ABSTRACT

Aspects of the invention include a child resistant packaging system that makes use of a container, a protective sleeve and a two part child resistant lid with inner lid and an outer lid that are co-axially aligned. The protective sleeve has a recessed groove that substantially matches a corresponding lip on the container enabling the protective sleeve to retain the container without a stretch fit. Also provided is a sleeve for protecting a container that is constructed from a molded silicone and has a recessed groove for retaining a container.

1 Claim, 8 Drawing Sheets

(56) References Cited

U.S. PATENT DOCUMENTS

| | | | | |
|---|---|---|---|---|
| 6,923,347 | B2 * | 8/2005 | Winckels | A45D 40/0068 206/229 |
| 7,574,789 | B2 * | 8/2009 | Reichenbach | B01L 3/5082 220/23.87 |
| 8,286,811 | B1 * | 10/2012 | Adamczak | B65D 50/041 215/220 |
| 8,579,133 | B2 | 11/2013 | Marcus et al. | |
| 2004/0262251 | A1 * | 12/2004 | Tauber | B65D 50/041 215/220 |
| 2007/0045320 | A1 * | 3/2007 | Biesecker | B65D 50/041 220/345.1 |
| 2009/0032486 | A1 * | 2/2009 | Brozell | B65D 50/041 215/220 |
| 2011/0139742 | A1 * | 6/2011 | Brozell | B65D 50/041 215/220 |
| 2011/0139798 | A1 * | 6/2011 | Maguire | A47G 19/22 220/669 |

* cited by examiner

CHILD RESISTANT LID AND PACKAGING

CROSS-REFERENCE TO RELATED APPLICATIONS

This application claims the benefit of application 62/091,750 filed 2014 Dec. 15 titled "Child Resistant Lid and Packaging"

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention is in the field of child resistant lids and associated packaging.

2. Summary of the Prior Art

Examples of child resistant packaging are common in the form of child resistant pill bottles. Typically, these pill bottles have a lid that screws onto a container via standard threads. The child resistant functionality is accomplished via a lid that does not unscrew via a standard left turning motion. Rather the lid is designed to unscrew when 2 or more motions are performed. Typically these motions are either push and turn, or squeeze and twist.

In the conventional child resistant lids there are inner and outer lids that are not rotationally fixed relative to one another. This allows an outer lid to twist while the inner lid remains stationary. The requisite steps required to couple the twisting motion of the outer lid to the inner lid are what make the lid child resistant. Conventional models use a plurality of ridges and ramped features on the inside of the outer lid and the top of the inner lid, respectively. These types of features are difficult to produce and require precision molds for the inner and outer lid to effectively work.

Additionally, with conventional lids which use a push and turn approach to child resistance, once a lid is pushed down, the outer and inner lid are coupled. It may be desirable to have a design which would allow for an outer and inner lid to slip relative to one another if sufficient downward pressure is not maintained on the outer lid. Such a system would provide an additional level of resistance to unintended openings.

SUMMARY OF THE INVENTION

The present invention is an article of manufacture that is particularly adapted for storing materials or compounds which require storage in a child resistant package. Other aspects of the invention are directed toward a container system which utilizes a glass container with a lip and a silicone protective sleeve with a recessed groove. Still further aspects of the invention are directed toward a silicone protect sleeve that has a taper and a recessed groove and in adapted for receiving a container.

DETAILED DESCRIPTION OF THE INVENTION

Figure 1:
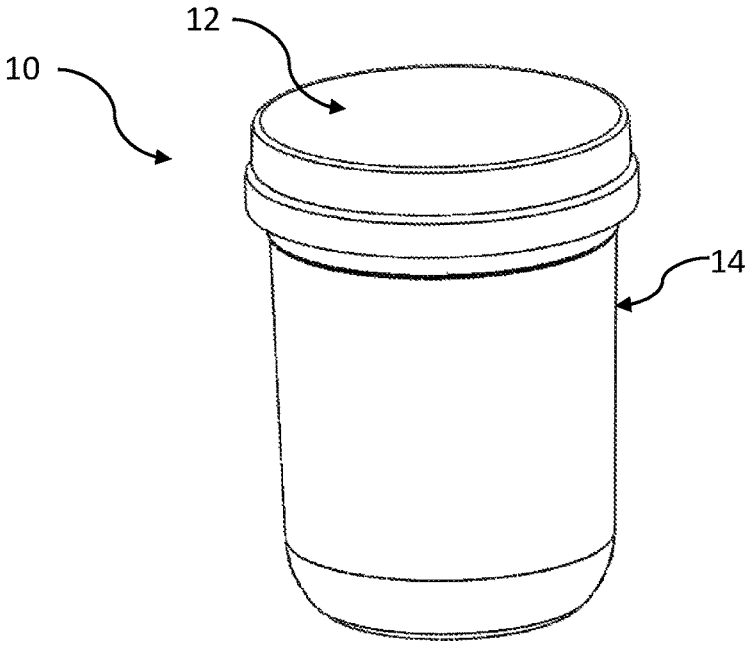
FIG. 1 depicts a preferred embodiment of the invention.
Figure 2:
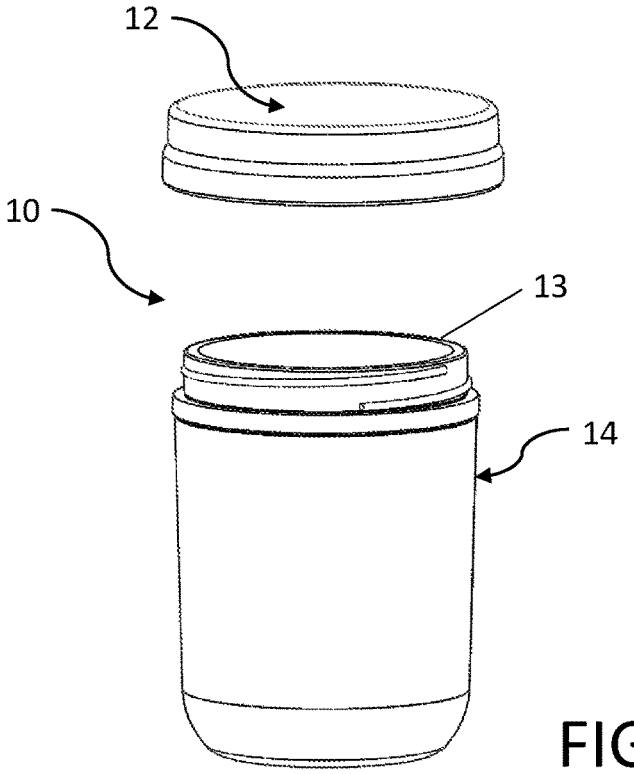
FIG. 2 depicts an exploded view of the embodiment of the invention depicted in FIG. 1.
Figure 3:
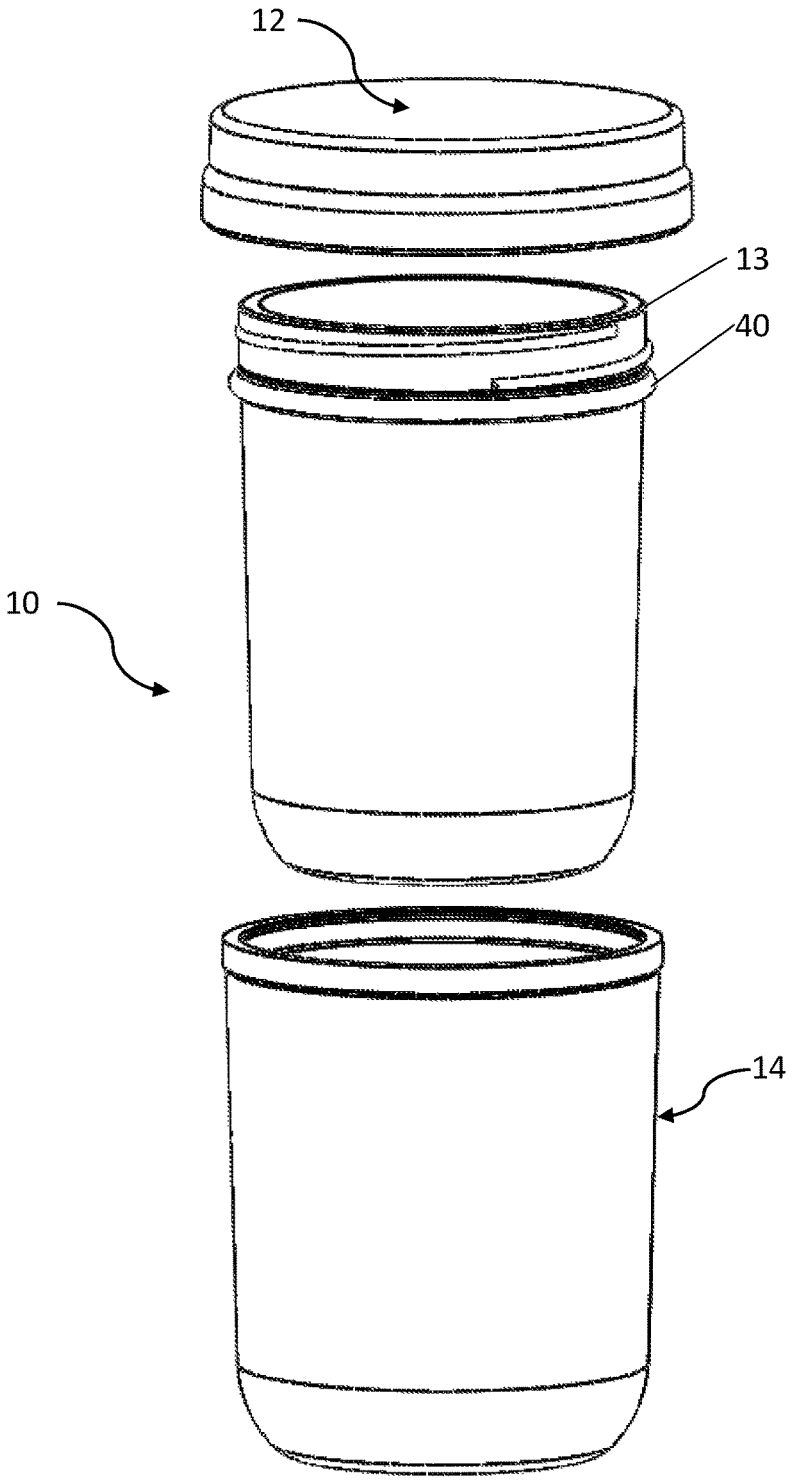
FIG. 3 depicts an exploded view of the invention depicted in FIG. 1.

FIG. 1 depicts an exemplary embodiment of a child resistant container 10. In the exemplary embodiment, the child resistant container 10 is comprised of a lid assembly 12 and protective sleeve 14. As further shown in the exploded views in FIG. 2 and FIG. 3, the lid assembly 12 threads onto a container 13 which is located within the protective sleeve 14. FIG. 3 particularly points out the relationship of the protective sleeve 14, container 13 and lid assembly. When assembled as in FIG. 1 the protective sleeve 14 and lid assembly 12 prevent any view of the contents of the container 13 in embodiments where the container 13 is constructed from a transparent material like glass or plastic. In some embodiments it may be desirable to prevent viewing of the container 13 contents in order to comply with federal or state regulations for product packaging. However, in other embodiments, the combination of protective sleeve 14 and lid assembly 13 may permit the contents of the container 13 to be visible.

Figure 4:
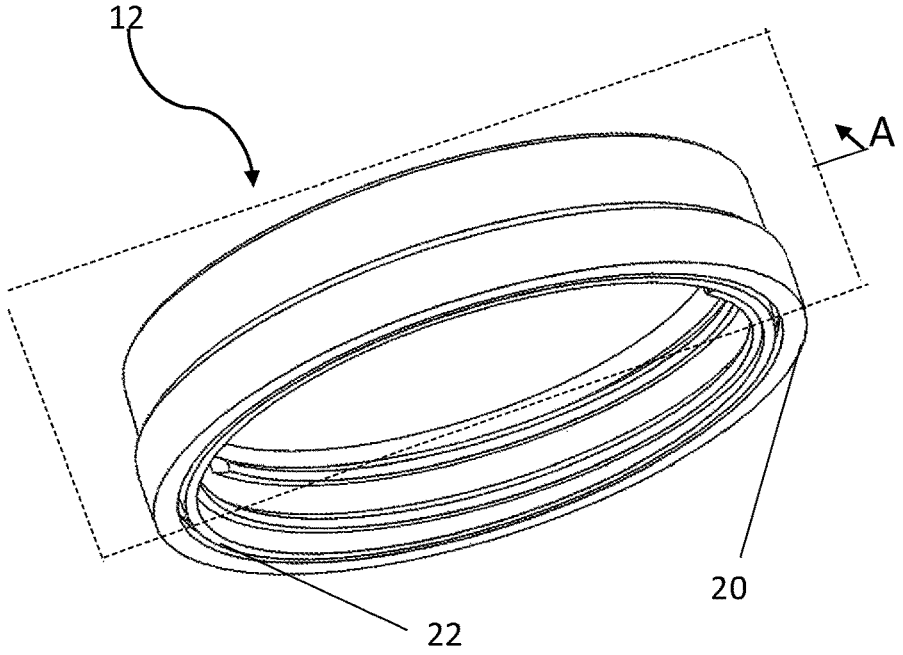
FIG. 4 depicts a preferred embodiment of a lid assembly according to the invention.

FIG. 4 depicts the lid assembly 12 in greater detail. The lid assembly 12 is comprised of an inner lid 22 and an outer lid 20. The inner lid 22 and outer lid 20 each have a central axis defined by their respective cylindrical faces. The central axis for the inner lid 22 and the outer lid 20 are substantially co-axial. The lid assembly 12 is preferably constructed from a fiber filled plastic material such as a poly-propylene that is 30% flax fiber by volume. However, the designs described herein permit the lid assembly 12 to be constructed from wood, metal, composites, ceramics or any other material which is substantially rigid.

Figure 5:
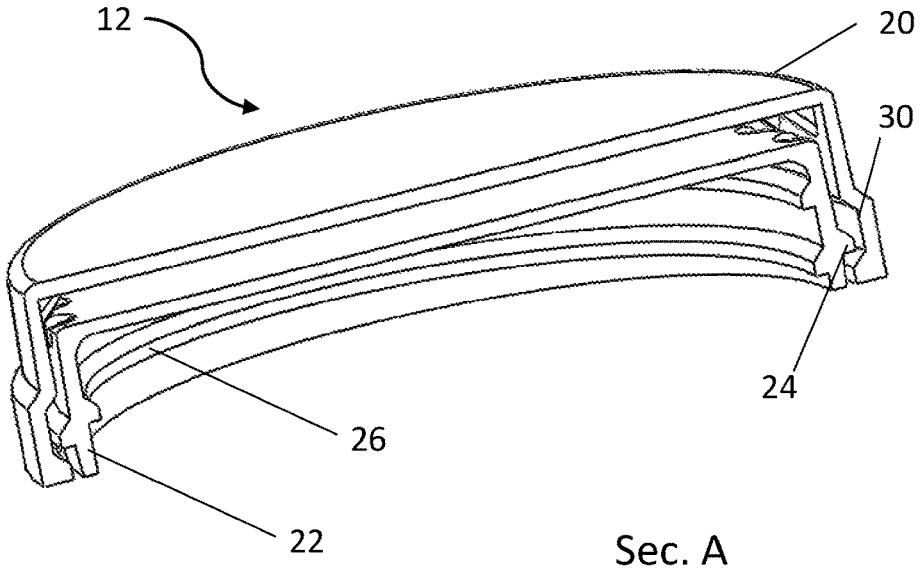
FIG. 5 depicts a section view of the lid assembly shown in FIG. 4 taken at A.

FIG. 5 provides a cross sectional view of the lid assembly 12 as shown in FIG. 4 taken at plane A. FIG. 5 shows the threads 26, the retaining lip 24 and the retaining groove 30. The retaining lip 24 is molded into the inner lid 22 and the retaining groove 30 is molded into the outer lid 20. During assembly, the inner lid 22 is pressed into the outer lid 20 whereby the retaining lip 24 seats in the retaining groove 30. The retaining groove 30 is sized such that the retaining lip 24 is capable of moving up and down within the retaining groove 30. Preferably, the retaining groove 30 permits movement of approximately ⅛". As little movement as 1/16" may be also suitable. In general, the outer lid 20 is permitted limited movement in the co-axial direction previously described relative to the inner lid 22.

Figure 6:
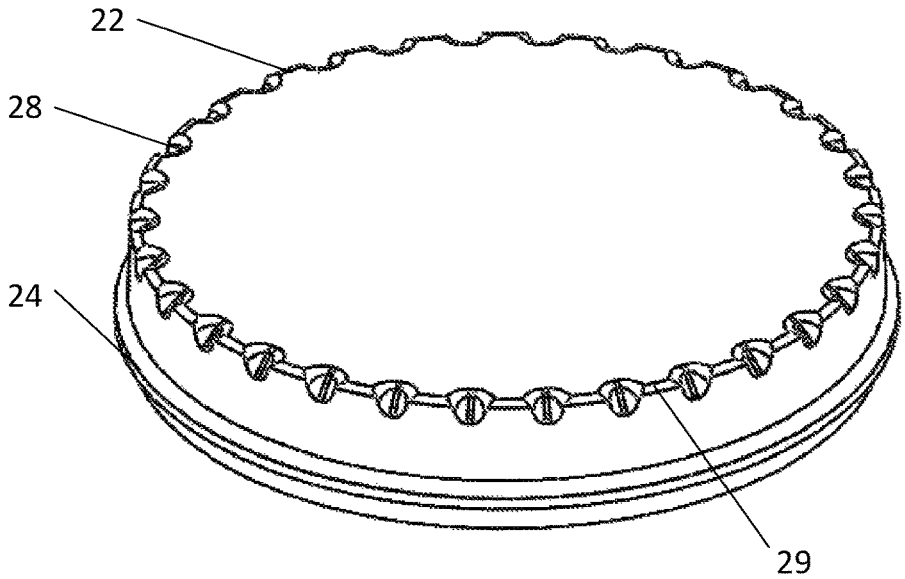
FIG. 6 depicts an embodiment of the inner portion of the lid assembly.
Figure 8:
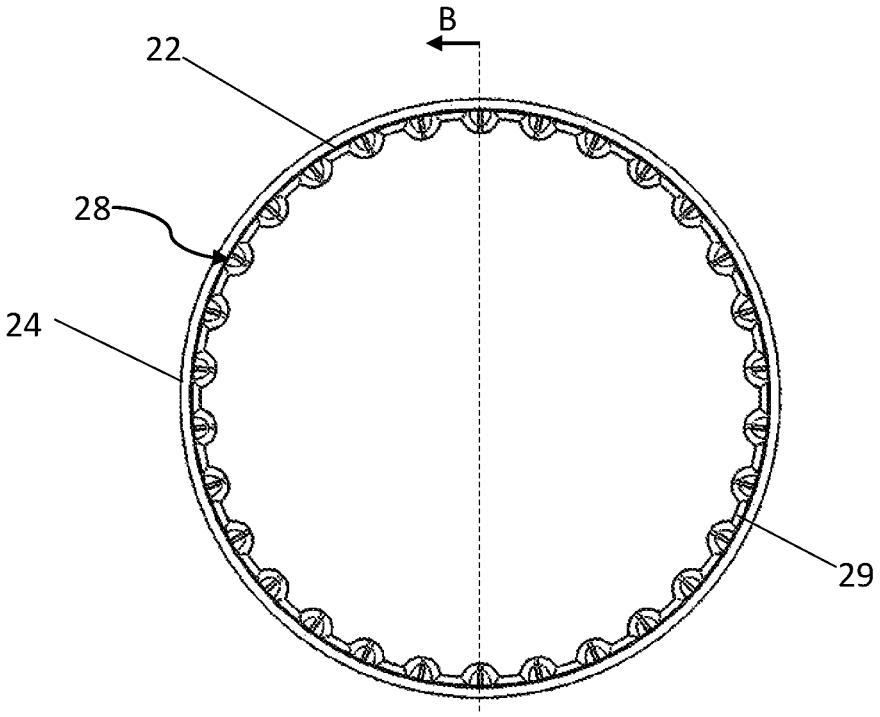
FIG. 8 depicts a top view of an embodiment of the inner portion of the lid assembly.
Figure 9:
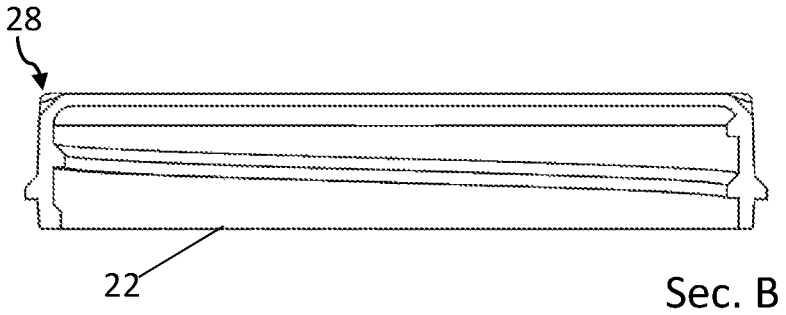
FIG. 9 depicts a cross section view of the lid assembly taken at plane B.

FIG. 6 shows the inner lid 22. Visible is the retaining lip 24 and a plurality of grooves 28. The plurality of grooves 28 are located circumferentially about the outermost top edge of the inner lid 22. The plurality of grooves 28 extend into the inner lid 22 without fully penetrating the inner lid 22. The grooves 28 are located at a substantially 45 degree angle relative to the top surface of the inner lid 22 and a substantially 45 degree angle relative to the cylindrical side surface of the inner lid 22. The edges of the plurality of grooves 28 are filleted such that the transition between the outermost edge 29 of the inner lid 22 and the plurality of grooves 28 is substantially continuous. The details of the plurality of grooves 28 are further shown in the top view of the inner lid 22 shown in FIG. 8 and the cross section view of the inner lid 22 shown in FIG. 9. Particularly, the fillets on the grooves are shown in FIG. 8. Additionally, the 45 degree groove angle is visible in the cross section view of FIG. 9 taken at plane B which intersects the centerline of 2 of the plurality of grooves 28. The exact number of grooves 28 may vary by application and the quantity of grooves depicted are exemplary only. The fewest suitable number of grooves is 3.

Figure 7:
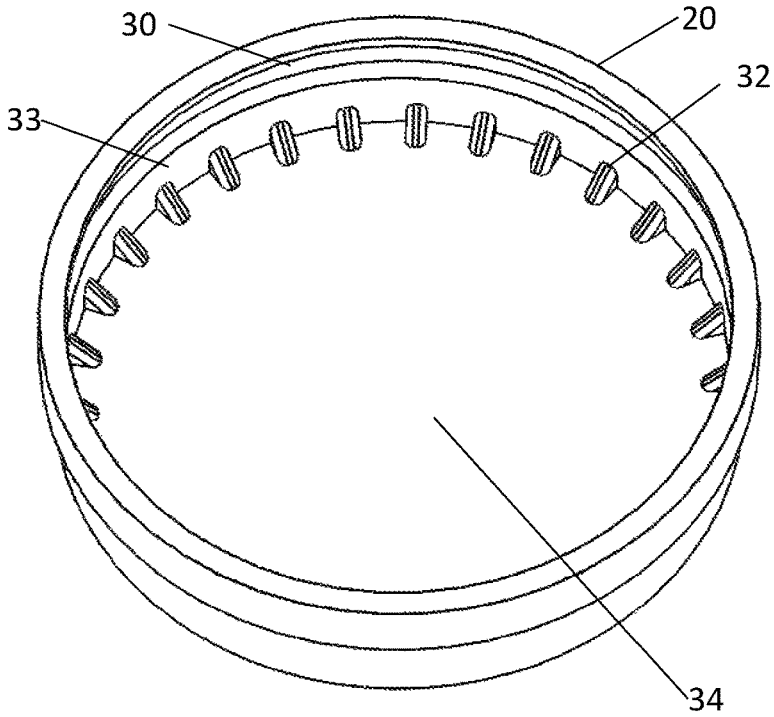
FIG. 7 depicts an embodiment of the outer portion of the lid assembly.

The plurality of grooves 28 provide an engagement means for the plurality of ribs 32 which are located on the outer lid 20. FIG. 7 shows the outer lid 20 in greater detail. The outer lid 20 contains a plurality of ribs 32 which are located in the corner defined by the inner top surface 34 of the outer lid 20 and the inner side surface 33. The exact number of the plurality of ribs 32 will vary by application, in a larger diameter lid, 3 may be sufficient, in a smaller diameter lid more may be necessary to provide sufficient engagement between the inner lid 22 and the outer lid 20. The number of ribs depicted in the figures is expressly intended to be exemplary and non-limiting. The plurality of ribs 32 have a substantially 45 degree angle relative to the inner side surface and the inner top surface 34. The ribs 32 in the preferred embodiment have a thickness of about 0.1" and are filleted 33 so that the plurality of ribs 32 each have a substantially smooth contour about the central axis defined by the inner side surface of the outer lid 20.

In operation the inner lid 22 is located within the outer lid 20 via the retaining lip 24 and retaining groove 30. The outer lid 20 is constrained to move up and down relative to the inner lid 22 within a fixed range according to the dimension of the locating groove 30. When a user places the lid assembly 12 on a container, the user presses on the outer lid 20 and turns the lid assembly to thread the threads on the inner lid 22 on the threads of the container. When the user pushes down on the outer lid 20, the outer lid 20 moves relative to the inner lid 22 allowing the plurality of ribs 32 to engage the plurality of grooves 28. When the plurality of ribs 32 are engaged with the plurality of grooves 28 the inner lid 22 and outer lid 20 become coupled.

To remove the lid assembly 12 from a container a user must press down on the outer lid 20 to engage the plurality of ribs 32 with the plurality of grooves 28 thereby coupling the inner lid 22 and outer lid 20 and allowing the user to rotate the inner lid 22 for removal of the lid assembly 12 from the container. As a result of the smooth contours of the outer edge 29 of the inner lid 22 and the smooth contours of the plurality of ribs 32, if positive pressure is not maintained on the lid assembly, the outer lid 20 will tend to move up from the inner lid 22 when rotated which results in decoupling the inner lid 22 from the outer lid 20. Thus, the lid assembly 12 provides a child resistant functionality by requiring a user to continuously apply positive pressure while rotating the lid assembly 12 for the inner lid 22 to rotate.

In some embodiments a piece of foam or compressible material may be located between the top surface of the inner lid 22 and the inner top surface 34 of the outer lid 20. This material will provide additional child resistant functionality by increasing the force necessary to couple the inner lid 22 and outer lid 20.

Figure 10:
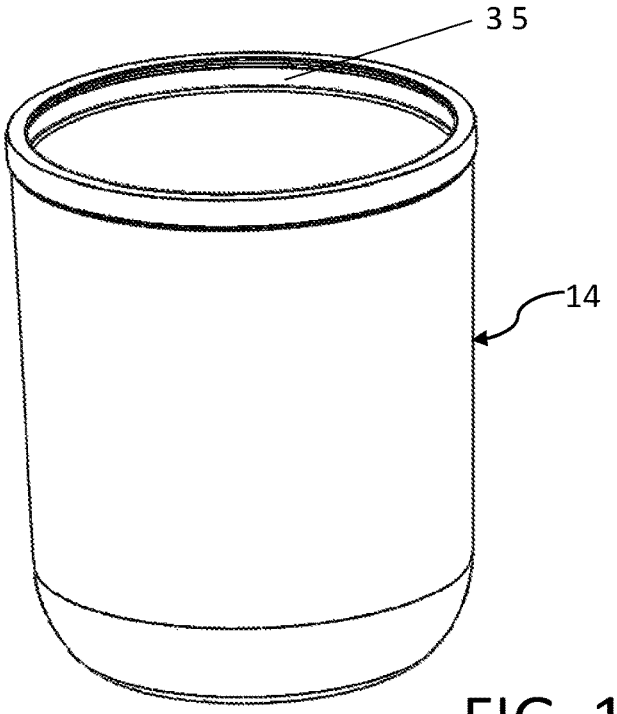
FIG. 10 depicts an embodiment of the protective sleeve.
Figure 11:
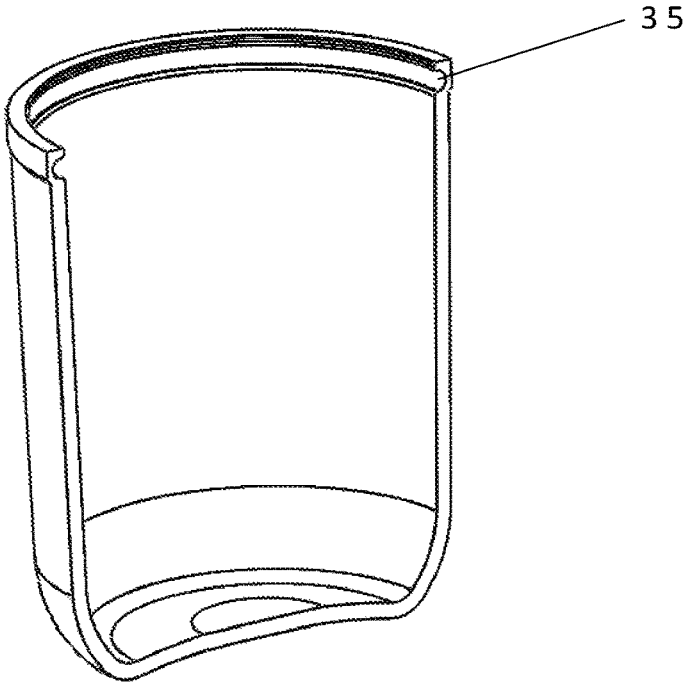
FIG. 11 depicts a cross section of the protective sleeve shown in FIG. 10.

FIG. 10 depicts an embodiment of the protective sleeve 14 in more detail. The protective sleeve is useful for preventing the viewing of the contents of the container 13 and protecting the container from impacts. The protective sleeve 14 is sized to closely fit the contours of the container 13 and has a recessed groove 35 that fits securely over a corresponding lip 40 on the container 13. FIG. 11 provides a cross section of the protective sleeve 14 taken at an arbitrary plane parallel and coincident to the central axis. This view helps to show the tubular construction of the protective sleeve 14. Notably, because the taper of the container 13 substantially matches the taper of the protective sleeve 14 the protective sleeve 14 does not need to be stretched over the container 13 in order to remain secure on the container 13. Instead, in some embodiments the combination of the recessed groove 35 positively resting on the container's 13 corresponding lip 40, and the substantially similar taper permits the protective sleeve to remain secure on the container 13. In other embodiments, the corresponding lip 40 may be the sole means of retaining the protective sleeve 14 on the container 13. The protective sleeve 14 can be constructed from a compression molded silicone, a liquid injection molded silicone or a thermoplastic elastomer.

Figure 12:
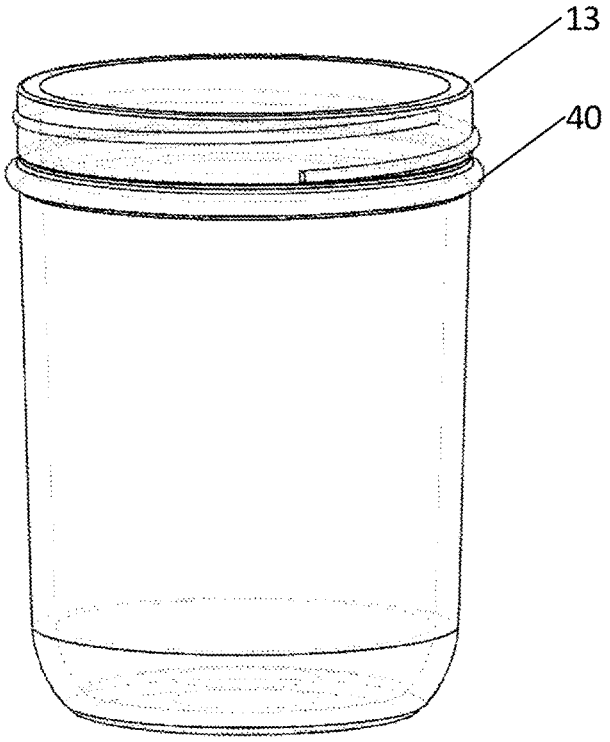
FIG. 12 depicts an embodiment of a container.

FIG. 12 depicts one embodiment of a container 13 constructed according to aspects of the inventions. The threads that would typically be located near the opening of the jar have been omitted for clarity. The container 13 has a corresponding lip 40 near the open end of the container. The container 13 may be constructed out of materials including glass, plastic, metal and wood. Additionally, the container may have a wide range of volumes, including 4 oz, 8 oz, 12, and 16 oz. As the size of the container 13 increases or decreases, the protective sleeve 14 will change in size to match the dimensions of the container 13 in the manner described above. The use of a protective sleeve 14 as part of a child resistant packaging system enables the container 13 to be made out of a transparent and/or fragile material that would otherwise be unsuitable for a child resistant packaging system.

Figure 13:
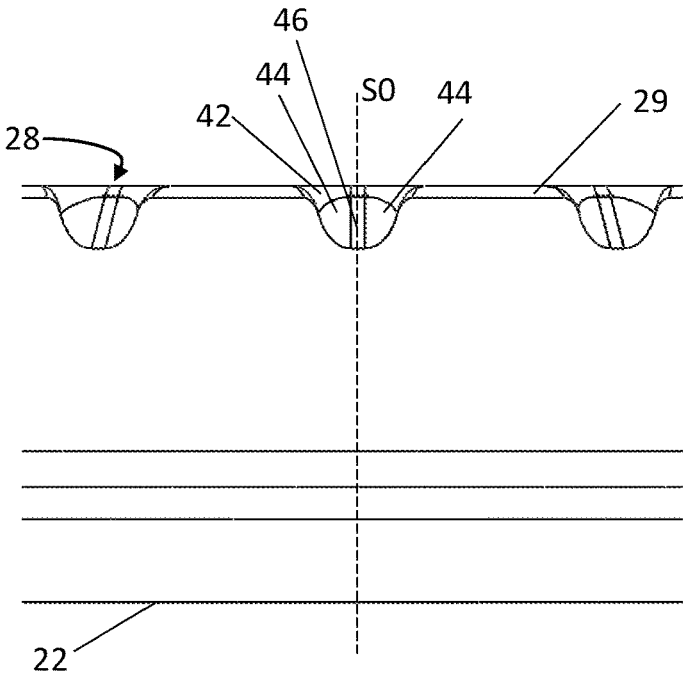
FIG. 13 depicts a magnified side view of a plurality of grooves on an inner lid.

FIG. 13 depicts a magnified side view of the inner lid. FIG. 13 specifically shows the various aspects of the embodiment of the groove 28 as depicted in FIGS. 5, 6, 8 and 9. Particularly, FIG. 13 shows a dashed line (which represents the edge of a plane) S0 about which the groove 28 is symmetrical, the groove bottom 46, the groove sidewall 44 and the groove edge 42. Referring to the groove bottom 46 in more detail, the groove bottom 46 has an approximately 45-degree angle relative to the top surface of the inner lid 22 and an approximately 45 degree angle relative to the cylindrical side surface of the inner lid 22. In the embodiment shown, the groove bottom 46 is flat, but it can also be curved. Referring to the groove sidewall 44 in more detail, the groove sidewall 44 indicates the transition region between the groove bottom 46 and the groove edge 42. The groove sidewall 44 smoothly transitions from the groove bottom 46 to the groove edge 42. Notably, across the line S0, the groove 28 is generally symmetrical. Thus, the groove sidewall 44 is substantially the same on either side of the groove bottom 46. Focusing on line S0, the plane which this line depicts is the plane that is defined by a line resting on the center of the groove bottom 46 (such as S1 and S2 in FIG. 14) and the center axis of the inner lid 22. Each groove 28 is symmetrical about the plane defined for that groove 28 as just described.

Referring to the groove edge 42 in more detail, the groove edge 42 refers to the transition region between the groove bottom 46 and the groove sidewall 44 and the other surfaces of the inner lid 22. The groove edge 42 is smooth such that the transition between the outermost edge 29 of the inner lid 22 and the plurality of grooves 28 is substantially continuous. In practice, this means that in use, relative to the direction of rotation, the plurality of ribs 32 on the outer lid 20 will only contact a ramped or horizontal surface on the inner lid 22.

Figure 14:
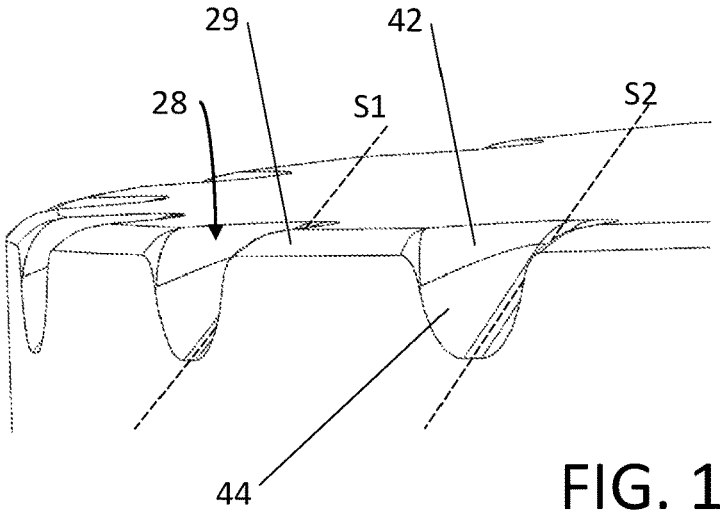
FIG. 14 depicts a magnified perspective view of an inner lid.

Referring to FIG. 14 in more detail, FIG. 14 is a magnified view of a plurality of grooves 28 on the inner lid 22. Lines S1 and S2 depict the lines that when combined with the center axis of the inner lid 22 define a plane about which an instance of a groove 28 is symmetrical. In operation, a rib 32 from the outer lid 20 will generally rest within a groove 28. As a user attempts to twist the outer lid 20, the rib 32 will contact the groove side wall 44 and create a force that pushes the inner lid 22 and outer lid 20 apart. If the user does not provide a downward force the outer lid will continue to rise and rotate and eventually the rib 32 will be resting on the outer edge 29 of the inner lid 22. Further rotation will move the rib 32 along the outer edge 29. As previously described, the groove 28 is designed with a continuous nature such that a rib 32 will not contact a perpendicular face on the inner lid 22 as the rib 32 contacts the groove 28 and outer edge 29 of the inner lid 28. Moreover, due to the symmetrical nature of the groove 28 the foregoing is true regardless of which direction the user turns the outer lid 20.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. A child resistant packaging system comprising:

a container; and a protective sleeve; and a child resistant lid comprising an inner lid and an outer lid that are co-axially aligned; and wherein said protective sleeve has a recessed groove located on the interior surface of said protective sleeve that substantially matches a corresponding lip on said container; and wherein said inner lid comprises a cylindrical side surface and a top surface with a plurality of grooves located at approximately 45 degrees to said top surface and side surface, wherein said plurality of grooves are individually symmetrical about a plane defined by a line through the center of each instance of said plurality of grooves and a central axis of said inner lid, and said outer lid comprises a plurality of ribs; and whereby said inner lid and said outer lid may be rotationally coupled by bringing said plurality of ribs and said grooves into contact.

* * * * *